United States Patent [19]

Marciano-Agostinelli et al.

[11] Patent Number: 5,010,209

[45] Date of Patent: Apr. 23, 1991

[54] POWER CABLE WITH WATER SWELLABLE AGENTS AND ELONGATED METAL ELEMENTS OUTSIDE CABLE INSULATION

[75] Inventors: Fabrizio Marciano-Agostinelli, Columbia, S.C.; Marco Barbaro-Forleo, Short Hills, N.J.; Carlo Marin, Vigevano, Italy; Paul L. Cinquemani, Lexington, S.C.

[73] Assignee: Pirelli Cable Corp., Florham Park, N.J.

[21] Appl. No.: 404,320

[22] Filed: Sep. 7, 1989

Related U.S. Application Data

[60] Continuation-in-part of Ser. No. 287,486, Dec. 20, 1988, which is a continuation-in-part of Ser. No. 68,670, Jul. 1, 1987, which is a division of Ser. No. 864,196, May 16, 1986, Pat. No. 4,703,132.

[51] Int. Cl.[5] ..... H01B 7/28

[52] U.S. Cl. ..... 174/23 C; 174/23 R; 174/102 SC; 174/105 SC

[58] Field of Search ..... 174/23 R, 23 C, 102 SC, 174/102 SP, 105 SC, 108; 156/48

[56] References Cited

U.S. PATENT DOCUMENTS

| | | | |
|---|---|---|---|
| 2,886,631 | 5/1959 | Muller | 174/108 |
| 3,538,235 | 11/1970 | Arendt | 174/23 C |
| 3,558,801 | 1/1971 | Eilhardt | 174/23 C |
| 3,790,697 | 2/1974 | Buckingham | 174/108 X |
| 3,943,271 | 3/1976 | Bahder et al. | 174/102 D X |
| 4,105,619 | 8/1978 | Kaufman et al. | 174/23 C X |
| 4,360,704 | 11/1982 | Madry | 174/102 SC X |
| 4,435,613 | 3/1984 | Gaubert | 174/23 C X |
| 4,638,114 | 1/1987 | Mori | 174/108 X |
| 4,703,132 | 10/1987 | Agostinelli et al. | 174/23 R X |
| 4,791,240 | 12/1988 | Marin et al. | 174/23 C |
| 4,870,226 | 9/1989 | Kreuger et al. | 174/23 R X |

FOREIGN PATENT DOCUMENTS

| | | | |
|---|---|---|---|
| 2808214 | 9/1979 | Fed. Rep. of Germany | 174/23 R |
| 7210976 | 2/1973 | Netherlands | 174/23 R |
| 2080998 | 2/1982 | United Kingdom | 174/23 C |

OTHER PUBLICATIONS

Waterblocking, a Dutch Specialty, Lantor Group Brochure, pp. 1 through 4 (no date).

*Primary Examiner*—Morris H. Nimmo
*Attorney, Agent, or Firm*—Brooks Haidt Haffner & Delahunty

[57] ABSTRACT

A high voltage electrical power cable with a stranded central conductor encircled by insulation, a metal tape, metal strips or metal wires following helical paths outwardly of the insulation and a water swellable material at least between the adjacent edges of the tape, strips or wires. Preferably, the water swellable material is included with a polymeric material which is flowable at a temperature at least as low as 100° C., the polymeric material has a 100 gram needle penetration value in the range from 50–100 tenths of a millimeter at 25° C. and the water swellable material has a particle size not greater than 200 microns.

33 Claims, 6 Drawing Sheets

Plastic Jacket
10
22
Water Swellable Tape
12
7
Filling Compound With Water Swellable Material
Wire Serving
6
5
Insulation Stress Control Layer
Insulation
Conductor Stress Control Layer
4
Filling Compound With Water Swellable Material
2
Conductor Wires

POWER CABLE WITH WATER SWELLABLE AGENTS AND ELONGATED METAL ELEMENTS OUTSIDE CABLE INSULATION

This application is a continuation-in-part of copending application Ser. No. 287,486 filed Dec. 20, 1988 and entitled "Power Cable with Metallic Shielding Tape and Water Swellable Powder" which is a continuation-in-part of copending application Ser. No. 068,670, filed July 1, 1987 and entitled "Filling Compound for Multi-Wire Conductor of an Electrical Cable and Cables Including Such Compound" which is a division of application Ser. No. 864,196, filed May 16, 1986, now U.S. Pat. No. 4,703,132, the disclosures of which are incorporated herein by reference.

BACKGROUND OF THE INVENTION

High voltage electrical power cables having at least one elongated metal element, such as metal tape, straps or wires, disposed around the cable insulation, either extending parallel to the cable axis or helically wound around the insulation, are well known in the art. Generally, such cables include a central stranded conductor with a semi-conducting shield therearound which is covered by a layer of insulation. Insulation shielding, in the form of a semi-conducting layer, is around the insulation, and the elongated metal elements are disposed around the insulation shield. A protecting jacket is disposed around the metal elements.

It is also known in the art that when the insulation of such cables is exposed to moisture, such as when they are installed underground, "electrochemical trees" are formed in the insulation which shorten the life of the cable.

Furthermore, attempts have been made to prevent the formation of such "trees" by introducing a sealant between the strands of the conductor and between the insulation shield and the metallic shielding tape. See U.S. Pat. Nos. 3,943,271 and 4,130,450. However, it has been found that the mere introduction of sealant into such spaces is not entirely satisfactory when the sealant is merely asphalt/rubber or a polyester compound which is not water swellable.

For example, voids may be formed in the sealant during the application thereof or may be formed when the cable is punctured accidentally. Furthermore, the components of such a cable, being made of different materials, have different coefficients of expansion, and the components are subjected to different or varying temperatures during manufacture, storage and/or operation of the cable which can cause the formation of voids.

In addition, the straps or wires are usually spaced from each other in the direction circumferentially of the insulation which can result in spaces between the straps or wires for the migration of moisture. When the tape is wound with the edge portions of the overlapping, there is a small space between the overlapping tape and the insulation shield adjacent to the edge of the underlying tape and there may be some spaces between the overlapping edge portions of the tape. If the tape is wound with slightly spaced edge portions, there are spaces between the edge portions for the migration of moisture. Even if it is intended that the tape, which is relatively thin, be wound with abutting edge portions, spaces between the edge portions do occur because of manufacturing difficulties and tolerances. Such spaces may not be completely filled by the sealant when it is applied, but even if they are, voids can develop at such spaces when the cable, or its components, is subjected to temperature changes.

Any such spaces or voids form locations for the ingress of moisture which can cause the formation of the deleterious "electrochemical trees" in the cable insulation, and the conventional sealants used in the cables, being unaffected physically by water, cannot eliminate such voids.

BRIEF SUMMARY OF THE INVENTION

The invention relates to improvements in cables of the type having at least one elongated metal element disposed outwardly of the cable insulation.

In the preferred embodiment of the invention, in addition to treating the conductor with a water swellable material as described in said U.S. Pat. No. 4,703,132, a water swellable material, by itself or as part of the filling compound described in the last-mentioned said patent, is included in the spaces outside the insulation shield where voids can form. Thus, the water swellable material can be between the insulation shield and the elongated metal elements or the turns of a tape, between the elongated metal elements and/or between the elongated metal elements or turns of a tape and the cable jacket, and preferably, is in all such places. In this way, the voids are filled by the water swellable material which absorbs moisture and swells preventing further migration of the moisture.

BRIEF DESCRIPTION OF THE DRAWINGS

The objects and advantages of the invention will be apparent from the following detailed description of the presently preferred embodiments thereof, which description should be considered in conjunction with the accompanying drawings in which.

DETAILED DESCRIPTION OF THE INVENTION

Figure 1:
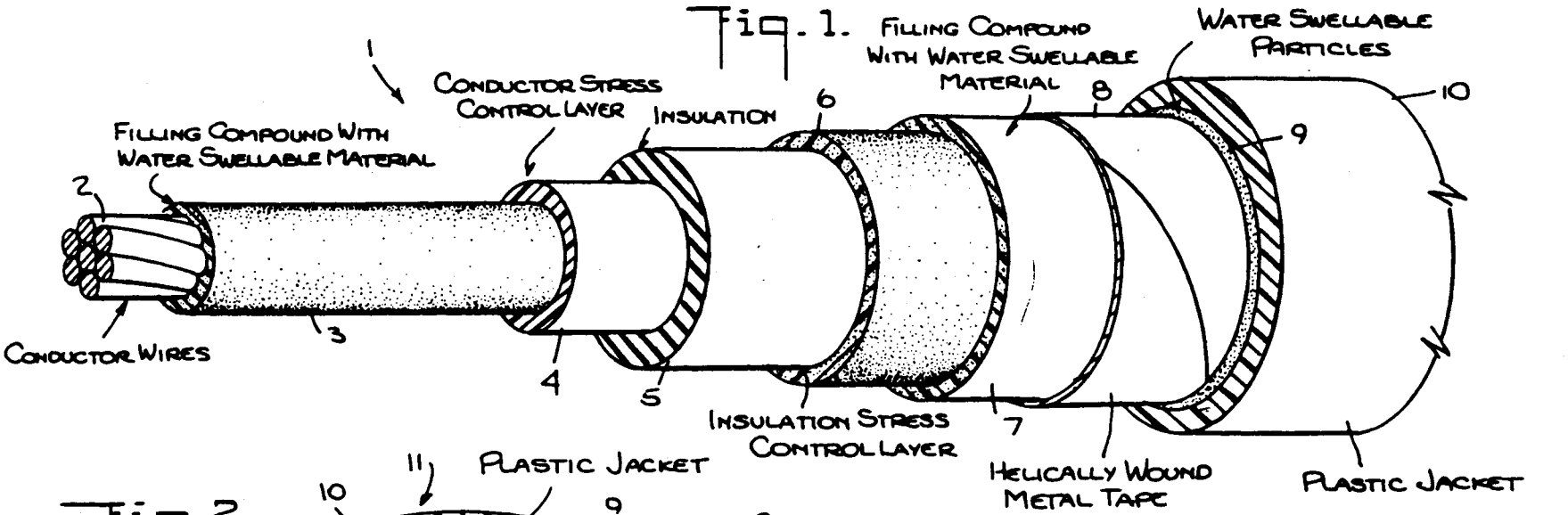
FIG. 1 is a cut-away, perspective view of a cable of the invention including metal tape wound helically around the semi-conducting insulation shield.

Although the principles of the invention are applicable to high voltage power cables of a different type, the invention will be described in connection with a known cable structure which normally comprises, as a minimum:

(1) A central conductor of stranded wires of a good conductivity metal such as copper, aluminum, copper alloys or aluminum alloys;

(2) A conductor shield around the conductor which usually is a layer of semi-conductive plastic which has been extruded over the conductor;

(3) A layer of polymeric insulation around the conductor shield and which has been extruded over the conductor shield;

(4) An insulation shield around the insulation and which usually is a semi-conductive plastic extruded over, or coated on, the layer of insulation;

(5) A metallic shield around the insulation shield and which usually is an elongated element, or elongated elements, in the form of copper or aluminum tape, straps or wires wrapped helically around the insulation shield; and (6) A jacket around the metallic shield and which usually is a polymeric material extruded over the metallic shield.

The cable may have a fewer or greater number of layers and, for example, it may have protective layers outside the jacket, such as helical wire serving, corrugated armor, etc. which is used in the art depending upon the conditions under which the cable is used. Also, the jacket may be of a material other than a polymeric material, and in cases where the water-swellable material is included in a semi-conductive filler which engages the conductor or the outer surface of the insulation, the conductor shield and the insulation shield, respectively, may be omitted.

In U.S. Pat. No. 4,703,132 referred to hereinbefore, high voltage power cables having the interstices of the stranded conductor filled with a filling compound containing water swellable particles for preventing the migration of water along the conductor and for preventing contact of moisture with the cable insulation and a preferred filling compound are described. Whenever a filling compound is referred to in this application, the preferred filling compound is the filling compound described in said Patent, but other filling compounds containing a water swellable material can be used. Said Patent also describes water swellable particles, and in the cable of the invention, the preferred water swellable particles are those described in said Patent although other water swellable particles can be used.

Said U.S. Pat. No. 4,703,132 and said application Ser. No. 287,486 are directed to cable areas of particular concern with respect the affecting of the cable insulation. A demand has arisen for a high voltage cable which is "fully sealed" cable, i.e. a cable which has all otherwise empty spaces within the cable jacket filled with a water swellable material, either alone, in a filling compound or as part of a tape. The present invention is directed to the prevention of water contact with the cable insulation by way of other portions of the cable and to a fully sealed cable.

It is known in the art that if the diameter of the insulation varies, due to the presence of layers of material outwardly of the insulation or otherwise, the dielectric, or voltage breakdown, strength of the insulation is lowered, particularly where the diameter of the insulation is smaller. Standards have been proposed for the maximum permissible indentation of the insulation.

When there is metallic shielding outside the insulation, indentations in the cable insulation can be caused when the jacket is extruded tightly over the metallic shielding to prevent water ingress. MYLAR tape has been applied over the metallic shielding, intermediate such shielding and the jacket, in an attempt to reduce such indentation of the insulation. The present invention is also directed to minimizing such indentations of the insulation which is accomplished by the use of water swellable material intermediate the jacket and the insulation. In this way, the jacket need not tightly enclose the layers therewithin to prevent water ingress. Instead, the jacket can be applied so that the significant indentations in the insulation are not caused, and water ingress is prevented by the water swellable material. Thus, the jacket can be applied over the metallic shield, e.g. tape, straps or wires, in a known manner which will prevent significant compression of the insulation.

FIGS. 1, 2, 4 and 5 illustrate embodiments of the cable of the invention in which the insulation is encircled by a helically wound metal tape, such as a copper or aluminum tape. In FIG. 1, a cable 1 comprises a conductor 2 of stranded wires of copper or aluminum or alloys thereof. Preferably, a layer 3 of semi-conductive filling compound containing water swellable particles encircles the conductor 2 and fills any spaces between the wires of the conductor 2, but alternatively, the conductor 2 may merely have the particles themselves filling such spaces and on the surface of the wires of the conductor 2. As a further, but less preferable alternative, the layer 3 and the particles may be omitted.

The preferred electrical cable conductor filling compound comprises a polymer which can be readily pumped at elevated temperatures about 100° C. Normally, this means that the polymer will be a low molecular weight polymer such as low molecular weight polyisobutylene rubber and a low molecular weight copolymer of isobutylene-isoprene rubber and can be a mixture of ethylene propylene rubber compounded with a substantial amount of carbon black as described in said U.S. Pat. Nos. 4,095,039 and 4,145,567 or other suitable mineral fillers. Other polymers having such characteristics will be apparent to those skilled in the art. A polymer which has been found to be particularly suitable is low molecular weight LM polyisobutylene sold by Exxon Chemical Americas, P.O. Box 3272, Houston, Tex. under the trademark VISTANEX.

The preferred base polymer of the filling compound of the invention does not have any significant Shore A hardness. A test of determining whether or not the base polymer has acceptable properties is the Penetrometer Test incorporated in ASTM D5 Penetration of Bituminous Materials. The 100 grams needle penetration value at 25° C. should be in the range from 110 to 180 tenths of a millimeter.

The material which swells or expands in the presence of water should be a powder having the following properties:

(a) The powder has to be substantially insoluble in water.

(b) The ph of the water dispersion of the powder obtainable by dispersing 1 gr. of powder in 200 $cm^3$ of bi-distilled water should be in the range from 6.5 to 7.5;

(c) The weight loss of the powder after heating at 105° C. should be lower than 7%;

(d) The powder wetting time (corresponding to the time lapse between the moment the powder is put in contact with water and the moment at which the expansion and swelling begins) should be in the range of less than 1 to 10 seconds whether the water is tap water, industrial use water, or sea water;

(e) The powder water absorbing capability expressed in $cm^3$ of water absorbed by 1 gr of powder should be in the range from 10 to 800 $cm^3$/gr or greater. In particular, the powder capability in relation to industrial water should be in the range from 200 to 800 $cm^3$/gr. or greater, while its capability for the absorption of sea water should be in the range from 10 to 150 $cm^3$/gr or greater; and (f) The particle size of the powder should be less than 200 microns and preferably, at least 50% of the particles of such powder should have sizes less than 150 microns.

Examples of materials which may be used for the swellable powders are polyacrylates and polyacrylamides, by themselves or copolymerized with natural polymers such as amides and cellulose and the esthers of, methyl cellulose and cellulose ethers, such as carboxymethyl cellulose. A material which has been found to be especially suitable in the Type J-550 sodium polyacrylate formerly sold by the Grain Processing Corporation, Muscatine, Iowa and now sold by Absorbent Technologies Corporation, Muscatine, Iowa.

The weight of the powder to the weight of the resin (PHR) may vary over a fairly wide range, but preferably, the powder is present from an effective amount to the amount necessary to provide the desired results which can be determined empirically. Normally, the powder will be present in an amount of at least 0.5 PHR to not more than 50 PHR and preferably, is present in an amount in the range from 0.5 PHR to 20 PHR.

In the preferred embodiments of the invention, the filler material that fills all spaces of the stranded conductor, as illustrated herein, is a compound of low molecular weight polyisobutylene rubber or a low molecular weight copolymer of isobutylene-isoprene rubber. To either of these isobutylene rubber materials 15 to 150 parts by weight of electrical conductive carbon black or graphite material or non-conductive mineral filler such as silica, talc, titanium dioxide, clay, is added for each 100 parts of the isobutylene rubber material.

The addition of the carbon makes the filler material semiconductive. The addition of the carbon or non-conductive mineral fillers serves an important function in that it prevents flow of the isobutylene rubber material at temperatures up to 200° C. Thus the filler material can withstand temperatures encountered during heavy loads on the power transmission lines without softening and having its viscosity become so low that it will flow out of the cable at cable ends or flow lengthwise where the cable is on a substantial slope.

Some material can be added, if necessary, as a processing aid; for example, a hydrocarbon oil, such as used in rubber compounding, or a chlorinated paraffin or isobutylene liquid plasticizer can be used to bring the isobutylene rubber compound to a pumping consistency without utilizing excessive heat. It is preferable, however, to use as little processing aid as possible or none at all when it is not necessary for obtaining a pumping consistency.

The disadvantages of the processing aids are that they may migrate into the insulation shield and cause swelling and a consequent reduction in the conductivity of the shield.

The amount of electrical conductive carbon black or graphite material or mineral filler which is mixed with the isobutylene rubber material is from 15 to 150 parts by weight of the filler to 100 parts of the isobutylene rubber compound; and the preferred range is from 15 to 50 parts. The 100 grams needle penetration of the preferred compound at 25° C. should be in the range of 50 to 100 tenths of a millimeter.

When particles of water swellable powder are applied as a thin layer over one, several or all layers of the filling compound applied over the concentric layers of wires, the thickness of the particles of water swellable powder preferably is on the order of several tens to several hundreds of microns.

The layer 3 is encircled by a conventional, semi-conductive layer 4 of a plastic material extruded over the layer 3, the layer 4 forming a conductor stress control layer. The layer 4 is encircled by a layer 5 of polymeric insulating material extruded over the conductor stress control layer 4. A semi-conductive layer 6 of plastic material encircles the insulation layer 5 and can be extruded over the layer 5 or applied thereto as a coating. The layer 6 is an insulation stress control layer.

Preferably, a layer 7 of the filling compound with water swellable particles previously described, and preferably, semi-conductive, is extruded over the insulation stress control layer 6. However, sufficient sealing without the layer 7 can be obtained, and the layer 7 can be omitted.

A metal shield, in the form of a copper or aluminum tape 8, is helically wound around the layer 7. Water swellable particles of the type previously described, and preferably, the sodium acrylate particles having a particle size of less than 200 microns, are applied to the outer surface of the tape 8 to form a layer 9 which encircles the tape 8. However, if the layer 7 is included and sufficient sealing without the layer 9 can be obtained, the layer 9 can be omitted.

The layer 9 of water swellable particles is encircled by a jacket 10, preferably, of extruded polymeric material.

The cable 1 described in connection with FIG. 1 can be used without further layers encircling the jacket 10, but under some conditions, it may be desirable to encircle the jacket 9 with one or more further layers, such as layers of bitumen and/or armoring in the form of helically wound steel wires or corrugated steel tape. These statements also apply to the embodiments of the cables described hereinafter.

Also, in the embodiments of the cables described hereinafter, the conductor and layers of the cables up to and including the insulation stress control layer 6 can be the same as those described in connection with FIG. 1.

Figure 2:
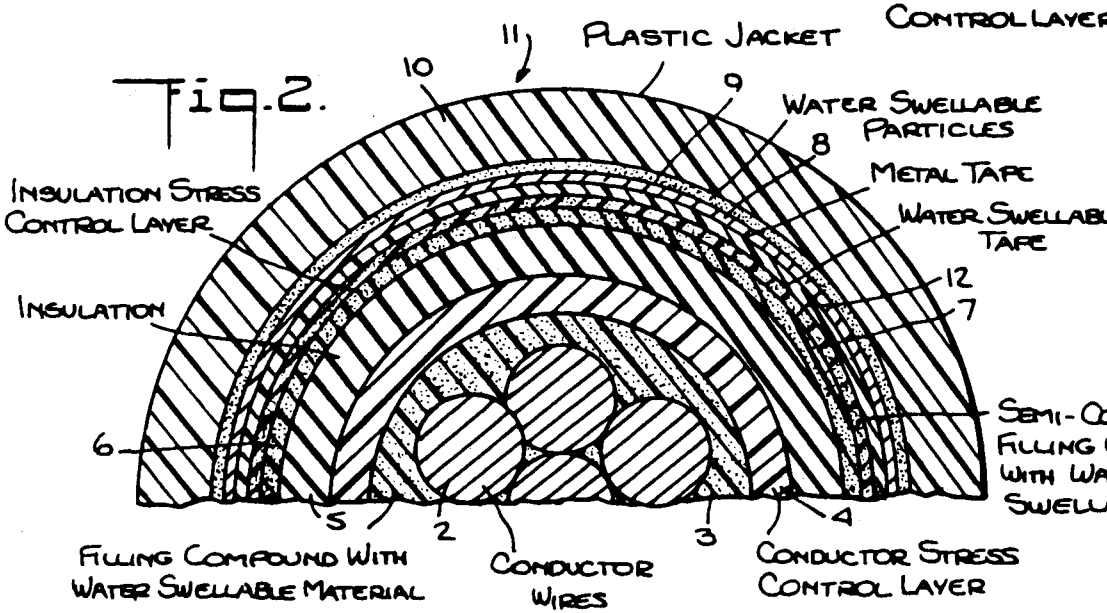
FIG. 2 is a fragmentary cross-sectional view of a modified embodiment of the cable shown in FIG. 1.

The cable 11 illustrated in FIG. 2 differs from the cable 1 illustrated in FIG. 1 by the addition of a layer 12 of helically wound water swellable tape intermediate the filling compound layer 7 and the metal tape 8. If desired, the layer 9 of water swellable particles may be omitted in cable 11.

Figure 3:
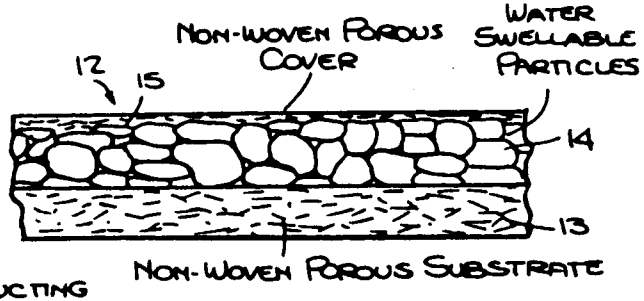
FIG. 3 is a fragmentary cross-sectional view of a water swellable tape forming part of the embodiment shown in FIG. 2.

The water swellable tape used for the layer 12 is a tape known in the art. One form of the tape is sold under the trademark FIRET by Lantor BV in Veenendal, Holland and is illustrated in enlarged cross-section in FIG. 3. The tape comprises a porous substrate 13 of non-woven plastic, e.g. bonded plastic fibers on which water swellable powder 14 is coated. The powder 14 is covered by a porous, non-woven, plastic cover 15.

Figure 4:
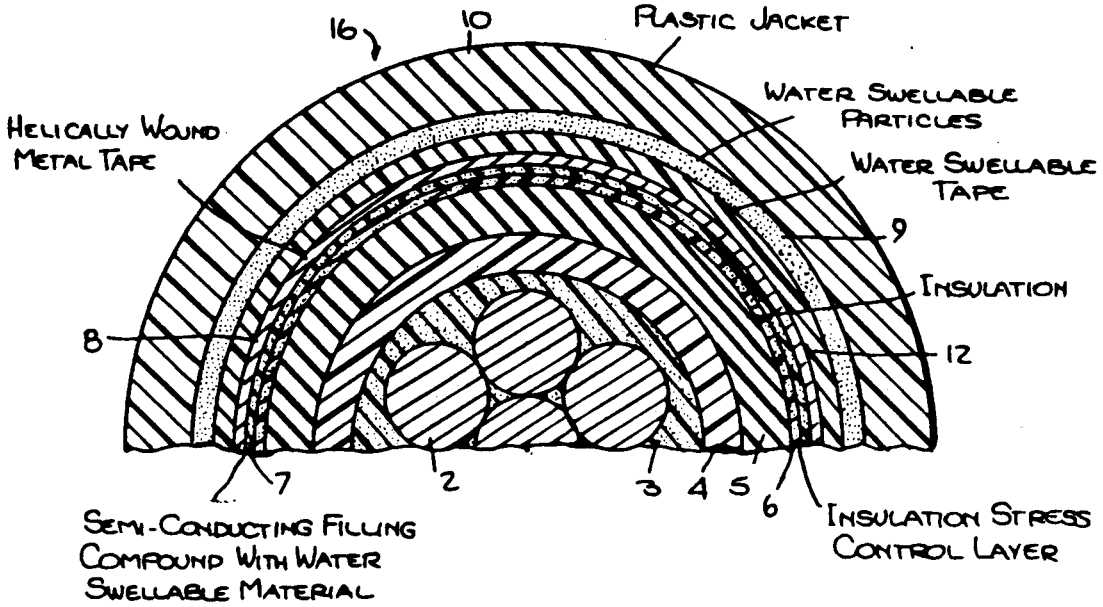
FIGS. 4 and 5 are fragmentary cross-sectional views of further modified embodiments of the cable shown in FIG. 1.

The cable 16 illustrated in FIG. 4 differs from the cable 11 in that the layer 12 of water swellable tape is outside, rather than inside, the metal tape 8 and is intermediate the metal tape 8 and the jacket 10. Again, if desired, the layer 9 of water swellable particles can be omittted.

Figure 5:
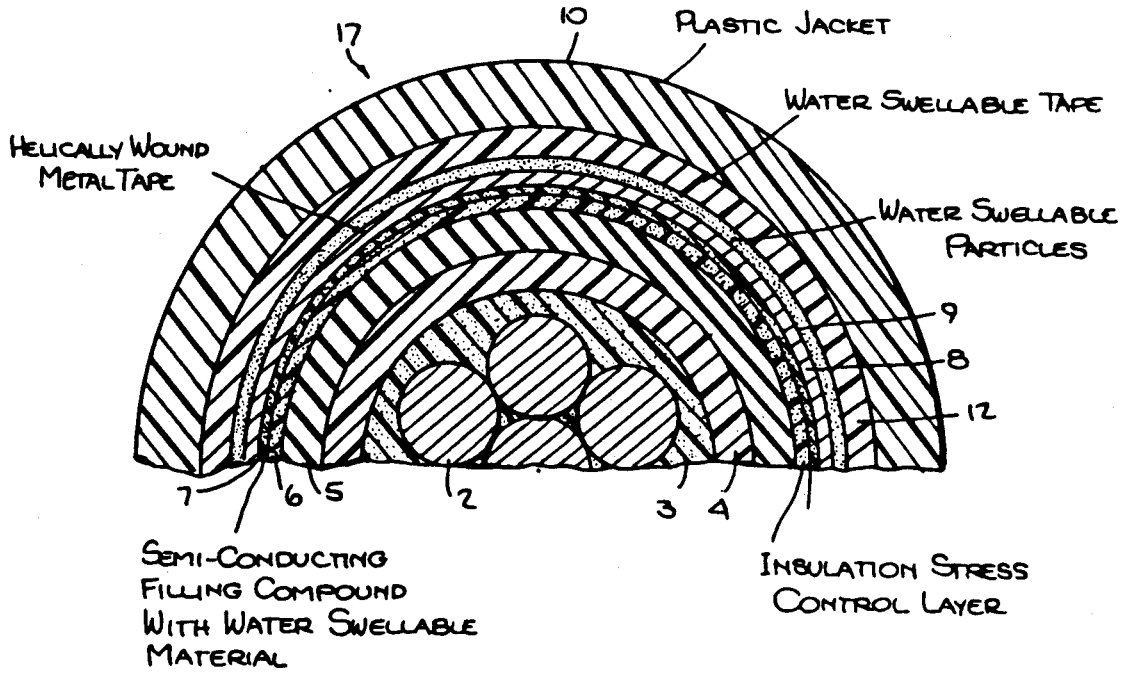

The cable 17 illustrated in FIG. 5 differs from the cable 16 in that the positions of the water swellable tape 12 and the water swellable particle layer 9 are interchanged, i.e., the tape 12 is radially outward, rather than radially inward, of the layer 9.

Figure 6:
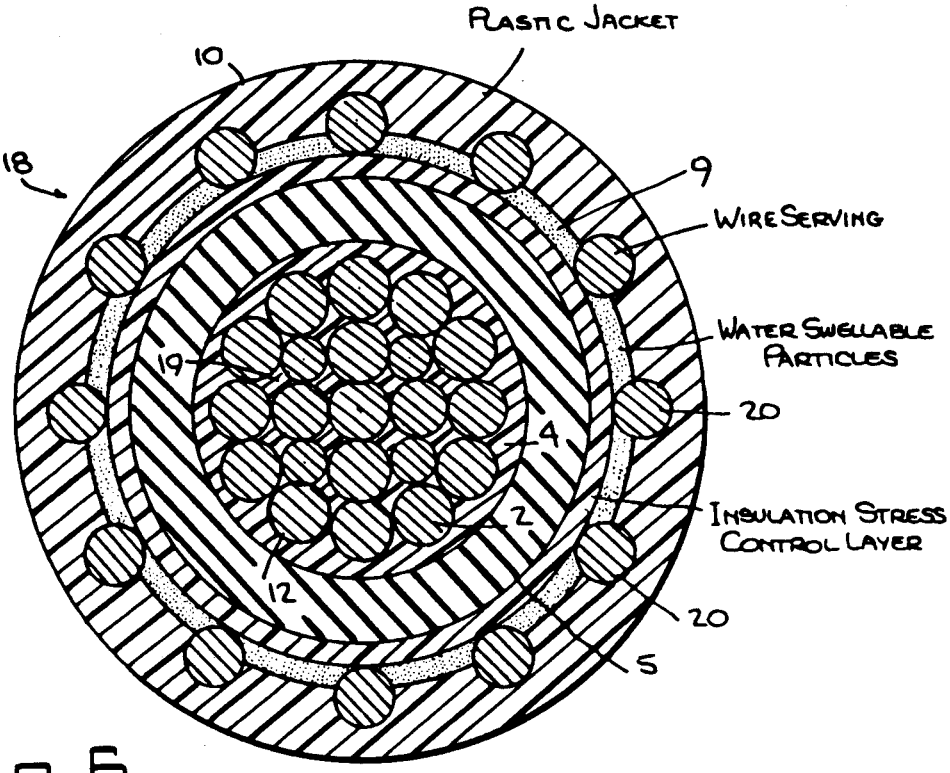
FIGS. 6–8 are similar to FIGS. 1, 2, 4 and 5 but the helically wound metal tape is replaced by wire serving in the cable.
Figure 7:
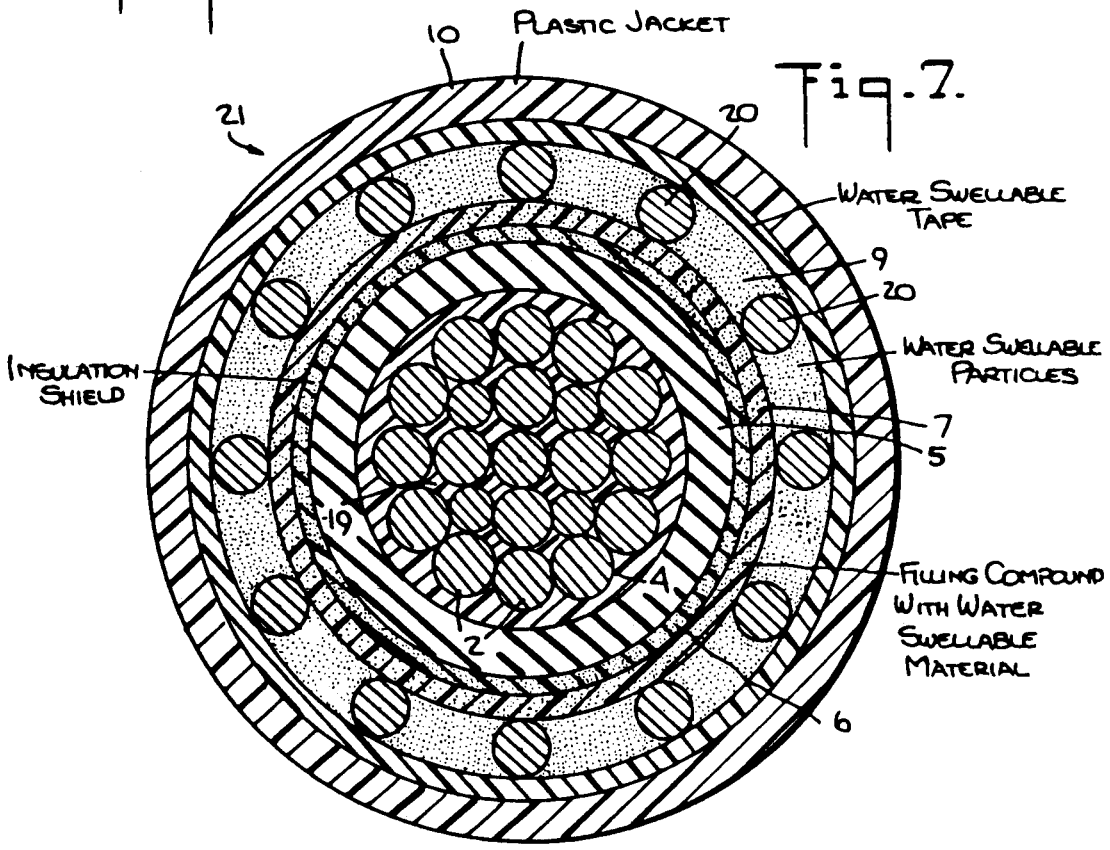
Figure 8:
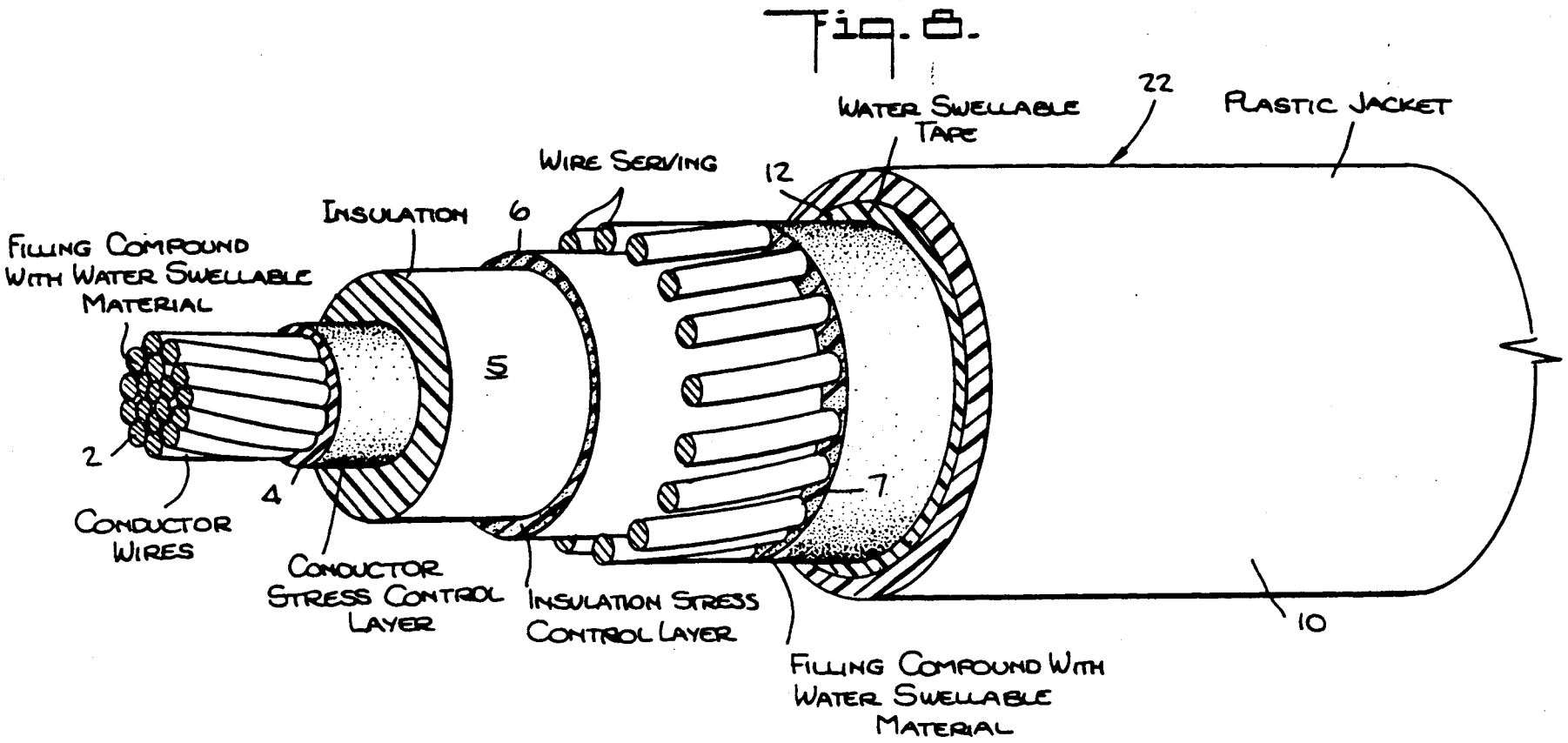
Figure 9:
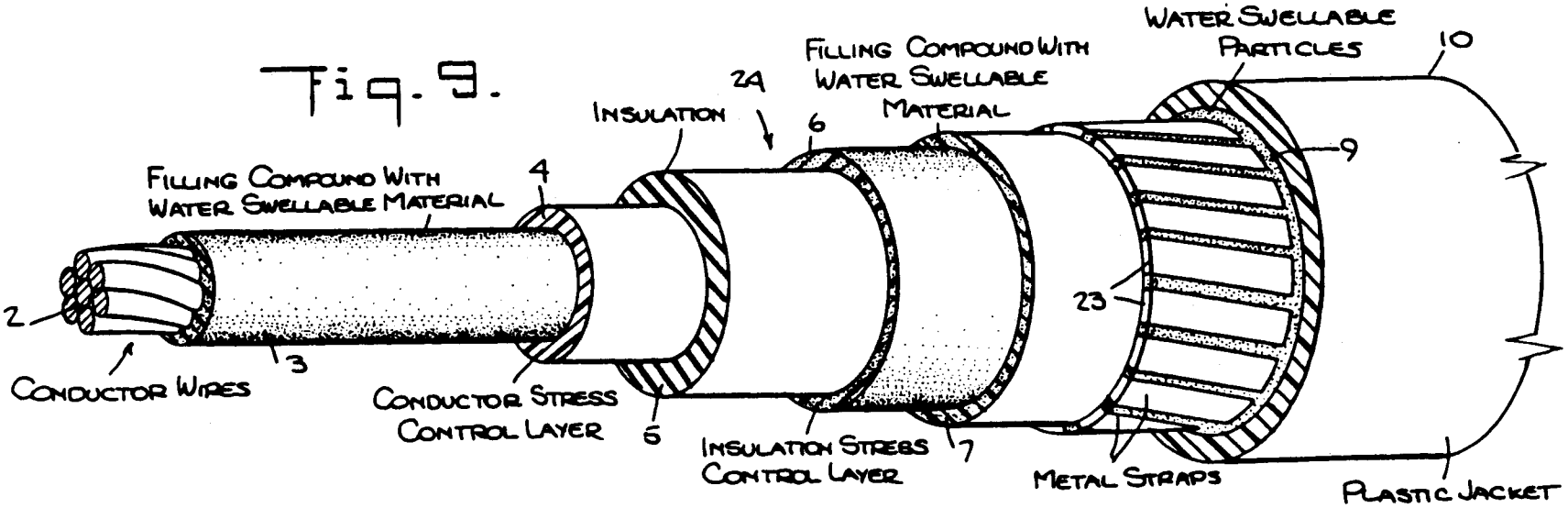
FIGS. 9–12 are similar to FIGS. 1, 2, 4 and 5 but the helically wound metal tape is replaced by metal straps.
Figure 10:
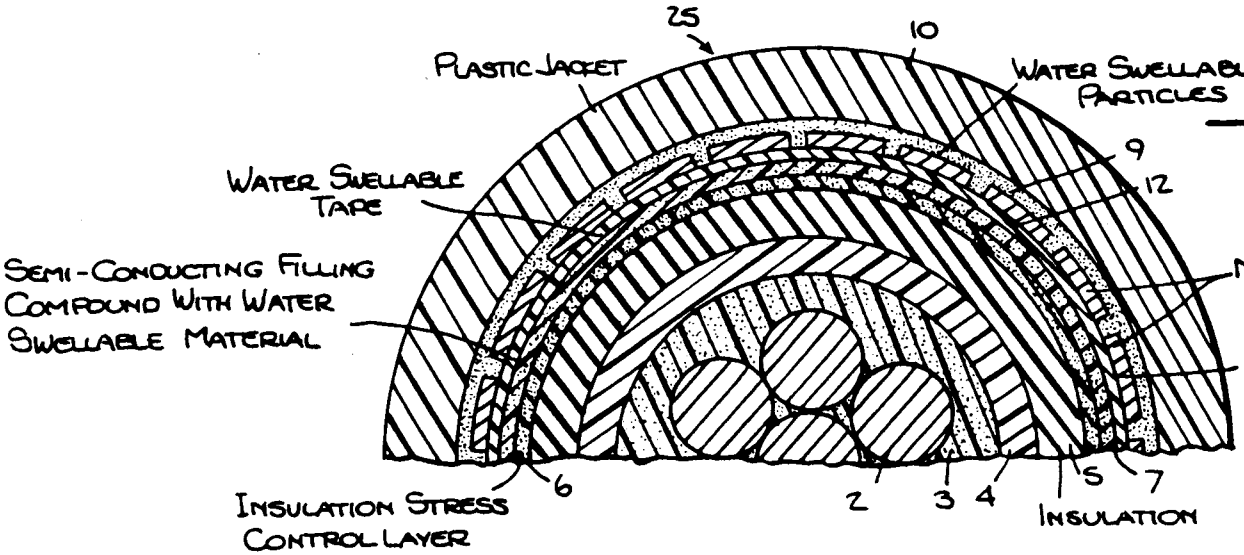
Figure 11:
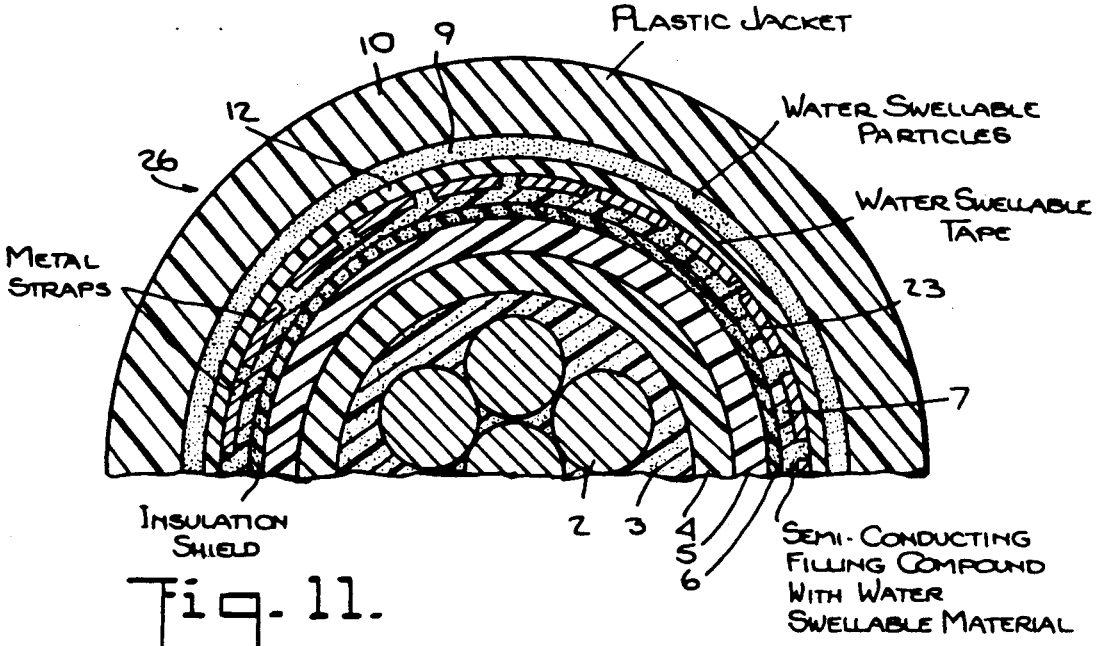
Figure 12:
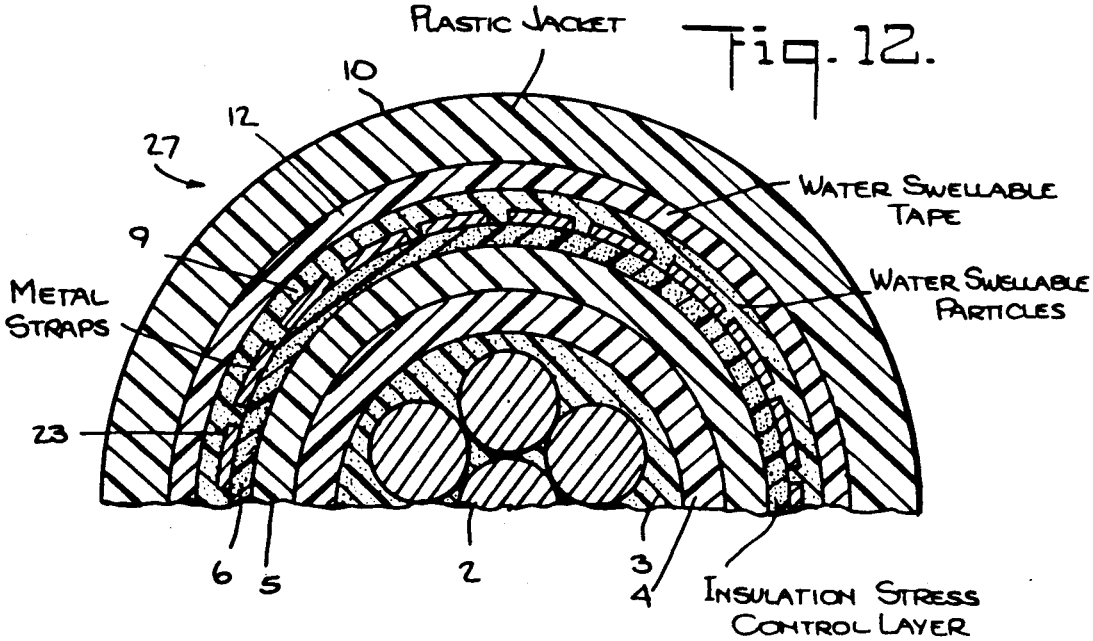

FIGS. 6–8 illustrate cables of the invention similar to the cables described in connection with the preceding figures except for the substitution of copper wire serving for the metal tape 8.

In the cable 18 illustrated in FIG. 6, a filling compound 19 which can be the same as the filling compound for the layer 3, is in the interstices between the conductor wires 2 but can be omitted. The conductors 2 are encircled by a stress control layer 4 which in turn is encircled by the insulation 5. The insulation 5 is encircled by the insulation stress control layer 6.

The wires 20 of the serving are helically wound, in circumferentially spaced relation, around the layer 5, are partially embedded in the extruded jacket 10 and are in contact with the layer 5. The wires 20 can be annealed copper wires.

The spaces between the wires 20 are filled with water swellable particles 9.

The cable 21 illustrated in FIG. 7 differs from the cable 18 illustrated in FIG. 6 in that the wires 20 are not embedded in the jacket 10, a layer 7 of the filling compound previously described and preferably, semi-conductive, is intermediate the insulation stress control layer 6 and the wires 20 and a layer of the water swellable tape 12 is intermediate the wires 20 and the jacket 10. If desired, the layer 7 can be omitted.

The cable 22 illustrated in FIG. 8 differs from the cable 21 illustrated in FIG. 7 in that the layer 9 of water swellable particles is replaced by the filling compound 7, preferably, semi-conductive and a separate layer 7 intermediate the wires 20 and the insulation stress control layer 6 is omitted. If desired, the layer of water swellable tape 12 can be omitted.

FIGS. 9–12 illustrate cables of the invention similar to the cables previously described except that the metal tape 8 and the wires 20 are replaced by metal straps 23, such as copper straps. Thus, the cables 24, 25, 26 and 27 in FIGS. 9, 10, 11 and 12, respectively, are the same as the cables 1, 11, 16 and 17 except for the substitution of the metal straps 23 for the metal tape 8. As described in connection with cables 1, 11, 16 and 17, certain layers can, if desired, be omitted in the cables 24, 25, 26 and 27.

It will be observed that in the embodiments described and which include water swellable material between the insulation and the jacket, it is not essential that the jacket tightly enclose the layers therewithin or enter into the spaces between the wires or straps, i.e. the interior size of the jacket can be essentially equal to the exterior size of the elongated elements so that compression of the elongated elements, and hence, indentation of the layers therewithin including the insulation, is prevented. Accordingly, the indentation of the insulation is reduced as compared to cables in which the jacket tightly encloses the layers therewithin, and the dielectric properties of the cables of the invention are improved as compared to the prior art cables.

Although preferred embodiments of the present invention have been described and illustrated, it will be apparent to those skilled in the art that various modifications may be made without departing from the principles of the invention.

We claim:

1. An electrical power cable comprising a stranded conductor formed by a plurality of wires stranded together, a semi-conductive stress control layer around said conductor, a layer of insulation around said stress control layer, a semi-conductive insulation shield around said insulation, said insulation shield having an outer surface of substantially constant cross-sectional radius and a metal shield which is disposed around said insulation shield and which is one of a helically wound metal tape, a plurality of metal straps and a plurality of metal wires, said metal shield having surfaces extending longitudinally of said cable and being adjacent to each other, and particles of a water swellable material at least at the adjacent surfaces of said metal shield.

2. An electrical power cable as set forth in claim 1 wherein said particles of water swellable material are distributed around the circumference of the surface of said insulation shield.

3. An electrical power cable as set forth in claim 2 wherein said particles of a water swellable material are admixed with an extrudable polymeric material and conductive particles in an amount sufficient to make the mixture semi-conductive.

4. An electrical power cable as set forth in claim 3 wherein said mixture has a 100 gram needle penetration value between 50 and 100 tenths of a millimeter at 25° C. and said particles of water swellable material have a size not greater than 200 microns.

5. An electrical power cable as set forth in claim 3 further comprising a jacket around said metal shield and particles of water swellable material intermediate said metal shield and said jacket.

6. An electrical power cable as set forth in claim 1 further comprising a jacket around said metal shield and wherein said particles of water swellable material are intermediate said metal shield and said jacket.

7. An electrical power cable as set forth in claim 1 wherein all otherwise empty spaced within said stress control layer contain water swellable particles.

8. An electrical power cable as set forth in claim 7 wherein said particles of a water swellable material are admixed with an extrudable polymeric material and conductive particles in an amount to make the mixture semi-conductive.

9. An electrical power cable as set forth in claim 8 wherein said mixture has a 100 gram needle penetration value between 50 and 100 tenths of a millimeter at 25° C. and said particles of water swellable material have a size not greater than 200 microns.

10. An electrical power cable as set forth in claim 1 further comprising a jacket around said metal shield and wherein all otherwise empty spaces within said jacket contain water swellable powders.

11. An electrical power cable as set forth in claim 10 further comprising a layer of a water swellable tape intermediate said insulation shield and said metal shield.

12. An electrical power cable as set forth in claim 10 further comprising a layer of a water swellable tape intermediate said metal shield and said jacket.

13. An electrical power cable as set forth in claim 1 further comprising a jacket around said metal shield, said jacket being of an interior size which prevents compression of said metal shield sufficient to cause significant indentation of said insulation by said metal shield and wherein said particles of water swellable material are contained in any otherwise empty spaces between said jacket and said semi-conductive insulation shield.

14. An electrical power cable comprising a stranded conductor formed by a plurality of wires stranded together, a semi-conductive stress control layer around said conductor, a layer of insulation around said stress control layer, a semi-conductive insulation shield around said insulation, and a metal shield which is disposed around said insulation shield and which is one of a helically wound metal tape, a plurality of metal straps and a plurality of said metal shield having surfaces extending longitudinally of said cable and being adjacent to each other, a layer of water swellable tape intermediate said metal shield and said insulation shield, and particles of a water swellable material admixed with an extrudable polymeric material and conductive particles in an amount sufficient to make the mixture semi-conductive at least at the adjacent surfaces of said metal shield.

15. An electrical power cable as set forth in claim 14 further comprising a jacket around said metal shield and particles of water swellable material intermediate said jacket and said metal shield.

16. An electrical power cable as set forth in claim 14 further comprising a jacket around said metal shield and a layer of water swellable tape and particles of water swellable material intermediate said jacket and said metal shield.

17. An electrical power cable comprising a stranded conductor formed by a plurality of wires stranded together, a semi-conductive stress control layer around said conductor, a layer of insulation around said stress control layer, a semiconductive insulation shield around said insulation, and a metal shield which is disposed around said insulation shield and which is one of a helically wound metal tape, a plurality of straps and a plurality of metal wires, said metal shield having surfaces extending longitudinally of said cable and being adjacent to each other, a jacket around said metal shield, a layer of water swellable tape intermediate said metal shield and said jacket, and particles of a water swellable material at least at the adjacent surfaces of said metal shield.

18. An electrical power cable comprising a stranded conductor formed by a plurality of wires stranded together, a semi-conductive stress control layer around said conductor, a layer of insulation around said stress control layer, a semi-conductive insulation shield around said insulation, said shield having an outer surface of substantially constant cross-sectional radius, and a metal shield formed by a plurality of metal wires wound helically around said insulation shield in circumferentially spaced relation, a jacket around said plurality of wires, and particles of water swellable material adjacent said wires.

19. An electrical power cable as set forth in claim 18 wherein said particles of water swellable material fill all otherwise empty spaces between said jacket and said insulation shield.

20. An electrical power cable as set forth in claim 18 wherein said particles of water swellable material are admixed with an extrudable polymeric material and conductive particles in an amount sufficient to make the mixture semi-conductive and wherein the mixture is intermediate said metal shields and said insulation shield.

21. An electrical power cable as set forth in claim 20 wherein said mixture has a 100 gram needle penetration value between 50 and 100 tenths of a millimeter at 25° C. and said particles of water swellable material have a size not greater than 200 microns.

22. An electrical power cable comprising a stranded conductor formed by a plurality of wires stranded together, a semi-conductive stress control layer around said conductor, a layer of insulation around said stress control layer, a semi-conductive insulation shield around said insulation and a metal shield formed by a plurality of metal wires wound helically around said insulation shield in circumferentially spaced relation, a jacket around said plurality of wires, a layer of water swellable tape intermediate said jacket and said metal shields and particles of water swellable material adjacent said wires.

23. An electrical power cable comprising a stranded conductor formed by a plurality of wires stranded together, a semi-conductive stress control layer around said conductor, a layer of insulation around said stress control layer, a semi-conductive insulation shield around said insulation and a metal shield formed by a plurality of metal wires wound helically around said insulation shield in circumferentially spaced relation, a jacket of polymeric material around said plurality of wires, said wires being at least partly embedded in said jacket and particles of water swellable material adjacent said wires.

24. An electrical power cable comprising a stranded conductor formed by a plurality of wires stranded together, a semi-conductive stress control layer around said conductor, a layer of insulation around said stress control layer, a semi-conductive insulation shield around said insulation and a metal shield formed of a plurality of metal wires wound helically around said insulation shield in circumferentially spaced relation, a jacket around said plurality of wires, a layer of water swellable tape intermediate said jacket and said metal shield, and particles of water swellable material adjacent said wires, said particles of water swellable material being admixed with an extrudable polymeric material and conductive particles in an amount sufficient to make the mixture semi-conductive and wherein the mixture is intermediate said wires and said insulation shield.

25. An electrical power cable comprising a stranded conductor formed by a plurality of wires stranded together, a semi-conductive stress control layer around said conductor, a layer of insulation around said stress control layer, a semi-conductive insulation shield around said insulation, said shield having an outer surface of substantially constant cross-sectional radius, and a metal shield formed by a plurality of metal straps wound helically around said insulation shield in circumferentially spaced relation, said straps having their edges extending longitudinally of said cable and being adjacent to each other, a jacket around said plurality of straps, and particles of water swellable material adjacent said straps.

26. An electrical power cable as set forth in claim 25 wherein said particles of water swellable material fill all otherwise empty spaces between said jacket and said insulation shield.

27. An electrical power cable as set forth in claim 25 wherein said particles of water swellable material are admixed with an extrudable polymeric material and conductive particles in an amount sufficient to make the mixture semi-conductive and wherein the mixture is intermediate said metal shields and said insulation shield.

28. An electrical power cable as set forth in claim 27 wherein said mixture has a 100 gram needle penetration value between 50 and 100 tenths of a millimeter at 25° C. and said particles of water swellable material have a size not greater than 200 microns.

29. An electrical power cable comprising a stranded conductor formed by a plurality of wires stranded together, a semi-conductive stress control layer around said conductor, a layer of insulation around said stress control layer, a semi-conductive insulation shield around said insulation and a metal shield formed by a plurality of metal straps wound helically around said insulation shield in circumferentially spaced relation, said straps having their edges extending longitudinally of said cable and being adjacent to each other, a layer of water swellable tape intermediate said jacket and said straps, and particles of a water swellable material at least at the adjacent edges of said straps.

30. An electrical power cable comprising a stranded conductor formed by a plurality of wires stranded together, a semi-conductive stress control layer around said conductor, a layer of insulation around said stress control layer, a semi-conductive insulation shield around said insulation and a metal shield formed by a plurality of metal straps wound helically around said insulation shield, said strap having their edges extending longitudinally of said cable and being adjacent to each other, a layer of water swellable tape intermediate said jacket and said metal shield, and particles of a water swellable material at least at the adjacent edges of said straps.

31. An electrical power cable comprising a stranded conductor formed by a plurality of wires stranded together, a semi-conductive stress control layer around said conductor, a layer of insulation around said stress control layer, a semi-conductive insulation shield around said insulation, said shield having an outer surface of substantially constant cross-sectional radius, a metal shield is disposed around said insulation shield and which is one of a helically wound metal tape, a plurality of metal straps and a plurality of metal wires, said metal shield having surfaces extending longitudinally of said cable and being adjacent to each other, a jacket around said metal shield, a layer of tape intermediate said jacket and said insulation shield, and particles of a water swellable material filling any otherwise empty spaces within said jacket.

32. An electrical power cable as set forth in claim 31 wherein said layer of tape is intermediate said insulation shield and said metal shield.

33. An electrical power cable as set forth in claim 31 wherein said layer of tape is intermediate said jacket and said metal shield.

* * * * *

UNITED STATES PATENT AND TRADEMARK OFFICE

CERTIFICATE OF CORRECTION

PATENT NO. : 5,010,209

DATED : April 23, 1991

INVENTOR(S) : Marciano-Agostinelli et al

It is certified that error appears in the above-identified patent and that said Letters Patent is hereby corrected as shown below:

Col. 8, line 32, "spaced" should read --spaces--;
Col. 9, line 3, after "of" --metal wires,-- should be inserted;
Col. 9, line 24, "semiconductive" should read --semi-conductive--;
Col. 9, line 56, "shields" should read --shield--;
Col. 10, line 4, "shields" should read --shield--;
Col. 10, line 58, "shields" should read --shield--;
Col. 12, line 8, before "is" --which--should be inserted.

Signed and Sealed this

Twentieth Day of October, 1992

*Attest:*

DOUGLAS B. COMER

*Attesting Officer*

*Acting Commissioner of Patents and Trademarks*